United States Patent [19]

Palau et al.

[11] Patent Number: 5,070,911

[45] Date of Patent: Dec. 10, 1991

[54] CONTROL DEVICE FOR DOUBLE SWINGING LEVER OF A DOBBY

[75] Inventors: Joseph Palau, Duingt; Jean-Paul Froment, Doussard; Jean-Pierre Pages, Faverges, all of France

[73] Assignee: S.A. des Etablissements Staubli (France), Faverges, France

[21] Appl. No.: 580,477

[22] Filed: Sep. 11, 1990

[30] Foreign Application Priority Data

Sep. 14, 1989 [FR] France ..... 89 12303

[51] Int. Cl.[5] ..... D03C 1/06

[52] U.S. Cl. ..... 139/71; 139/455

[58] Field of Search ..... 139/455, 67, 68, 69, 139/71, 72

[56] References Cited

U.S. PATENT DOCUMENTS

| | | | |
|---|---|---|---|
| 4,386,631 | 6/1983 | Mizoguchi | 139/68 |
| 4,557,298 | 12/1985 | Froment | 139/71 |
| 4,832,087 | 5/1989 | Palau et al. . | |

FOREIGN PATENT DOCUMENTS

| | | | |
|---|---|---|---|
| 1567237 | 11/1969 | France . | |
| 2599056 | 12/1987 | France . | |
| 64-14338 | 1/1989 | Japan | 139/71 |

*Primary Examiner*—Andrew M. Falik

*Attorney, Agent, or Firm*—Dowell & Dowell

[57] ABSTRACT

A double lift dobby for controlling the movement of the heddle frames of a weaving machine which includes coupling members pivotally connected at each end of double swinging levers which coupling elements are selectively engaged to oscillating plates by reading and transmission elements controlled by extendable members of an actuating mechanism.

8 Claims, 4 Drawing Sheets

CONTROL DEVICE FOR DOUBLE SWINGING LEVER OF A DOBBY

FIELD OF THE INVENTION

1. Background of the Invention

The present invention relates to dobbies for weaving machines and more particularly to dobbies of the type with drawn double swinging levers.

2. History of the Related Art

The dobbies according to the HATTERSLEY system are well known in the textile equipment industry. It is known that, in these dobbies, each of the heddle frames of the loom is connected to an oscillating lever which carries a double swinging lever of which each of the ends is provided with a coupling member in the form of an articulated drawing hook. Each drawing hook is selectively actuated by a traction member formed by a rigid knife having reciprocating movement, adapted to displace the swinging lever and the corresponding heddle frame as a function of the control received from the weaving program incorporated in the selection system. The system includes an actuation mechanism equipped with a program and associated with reading and transmission elements. This system acts on the drawing hooks which are displaced vertically so as either to cooperate with the traction knife or, on the contrary, to escape the movement thereof.

It has been proposed to reduce the dimensions of the HATTERSLEY dobbies of conventional type by causing the selection system to act no longer on the coupling members articulated at the ends of each double swinging lever, but on the traction members themselves. Reference may be made in this respect to French Patent No. 1 567 237 filed on Mar. 1, 1968 in the name of Gebr. STAUBLI et Co., which relates to an improved dobby whose general arrangement is schematically shown in FIG. 1 of the accompanying drawings.

In this Figure, reference 1 designates one of the heddle frames of the weaving machine, this frame being associated with springs 2 which tend to lower it. Frame 1 is connected by a cable 3 to an oscillating lever 4 which pivots at 5 on the fixed frame and which pivotally carries a double swinging lever 6. The ends of the lever are equipped with coupling members 7 including articulated arms 8*a* at the end of which is provided a profiled piece 8 for cooperating with a traction member 9. The two traction members 9 associated with the double swinging levers of the dobby are supported by two lateral plates 10 secured to a central shaft schematically shown at 11 and which are moved with an oscillating motion. It will be observed that the rear part of each piece 8 is shaped to engage in a cavity made in a corresponding fixed crosspiece 12 secured to the frame of the dobby, abutting on flat surfaces of the crosspiece.

In the embodiment disclosed in the French Patent mentioned above, each traction member 9 includes at each double swinging lever a sliding block 9*a* axially movable in a bearing surface 9*b* sectioned to receive piece 8 of the coupling member 7 which corresponds thereto. When the slide block 9*a* is controlled by a programmed selection system, the coupling member 7 is coupled to the traction member 9.

It will be readily understood that, when one of the traction members 9 pivots to cooperate with the corresponding coupling member 7, while the opposite piece 8 is in abutment against one of the two fixed crosspieces 12, the oscillation of plates 10 ensures traction of the double swinging lever 6 which then swings, raising frame 1 against springs 2.

The principal drawback of this particular type of dobby with drawn double swinging levers resides in the complexity of the selection system for controlling the traction members 9 as a function of the weave of the fabric to be produced. With each slide block 9*a* is associated a transmission device which comprises a pusher 13 associated with a bent lever 14. The two levers 14 are controlled by rods 15 displaced vertically by reading needles 16 so as to either cooperate with a knife 17 with reciprocating movement or to escape therefrom. The base of the needles 16 is supported by a punched card 18 of which the design or program corresponds to the desired weave.

It will be readily understood that such a system does not lend itself well to high-speed operation and that the risks of defects are relatively high. In addition, the complexity of the construction increases the cost of the dobby. Furthermore, it will be noted that springs 19 associated with the bent levers 14 tend to disengage the slide blocks 9*a* out of pieces 8 of coupling members 7, and, in order to avoid any untimely disconnection, elastic locking fingers 9*c* must be provided which further complicate the arrangement. Finally, any defective synchronization between the oscillating movement of the plates 10 (shaft 11) and that of the knives 17 may cause defects in weaving or failure in the mechanism.

SUMMARY OF THE INVENTION

It is a principal object of the present invention to overcome the drawbacks set forth hereinabove, by proposing a double lift dobby for weaving machines, of the type in which the coupling members articulated at the two ends of each double swinging lever are intended to cooperate, under the control of a selection system comprising a programmed actuation mechanism associated with reading and transmission elements, with mobile traction members carried by plates moved by an oscillating motion, characterized in that the reading and transmission elements are carried by the oscillating plates so as to cooperate in turn with a retractable stop of the actuation mechanism provided to be fixed.

According to the invention, the reading and transmission elements which, in combination with the programmed actuation mechanism control the coupling of the traction members with the coupling members of each double swinging lever, are carried by the oscillating plates.

It will be understood that such an arrangement considerably simplifies the construction of the selection system since the latter selection system does not ensure control of the double swinging lever in question; in fact, it is the oscillating plates forming supports for all the reading and transmission elements of the dobby which furnish this control at the same time as the traction effort.

Under these conditions, the programmed actuation mechanism of the selection system may include a simple wheel with pegs, or by a single assembly of electromagnets associated with pushers with reciprocating axial displacement.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
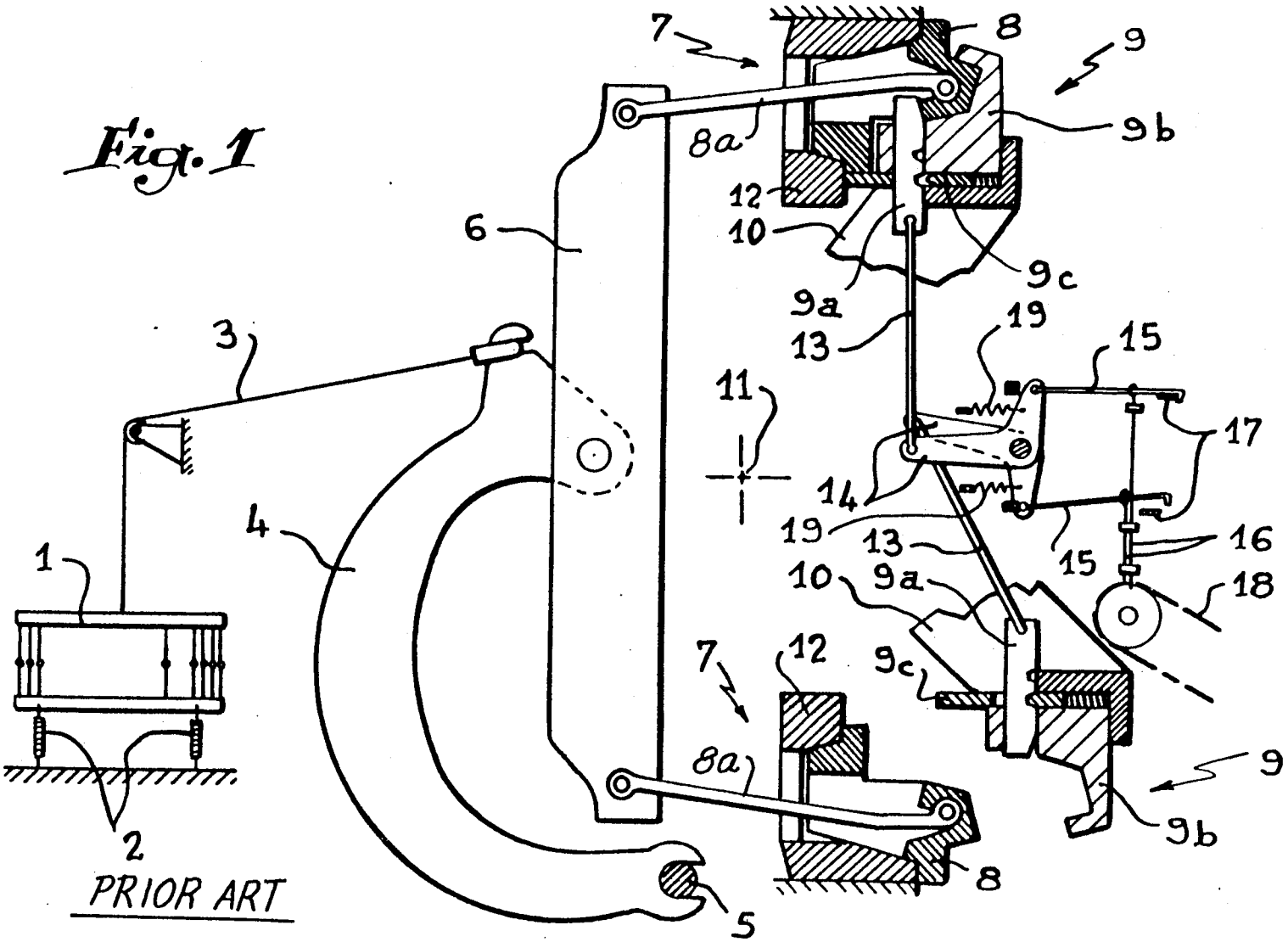
FIG. 1, as indicated hereinabove, is a transverse section illustrating the structure of a dobby with drawn double swinging levers of conventional construction.
Figure 2:
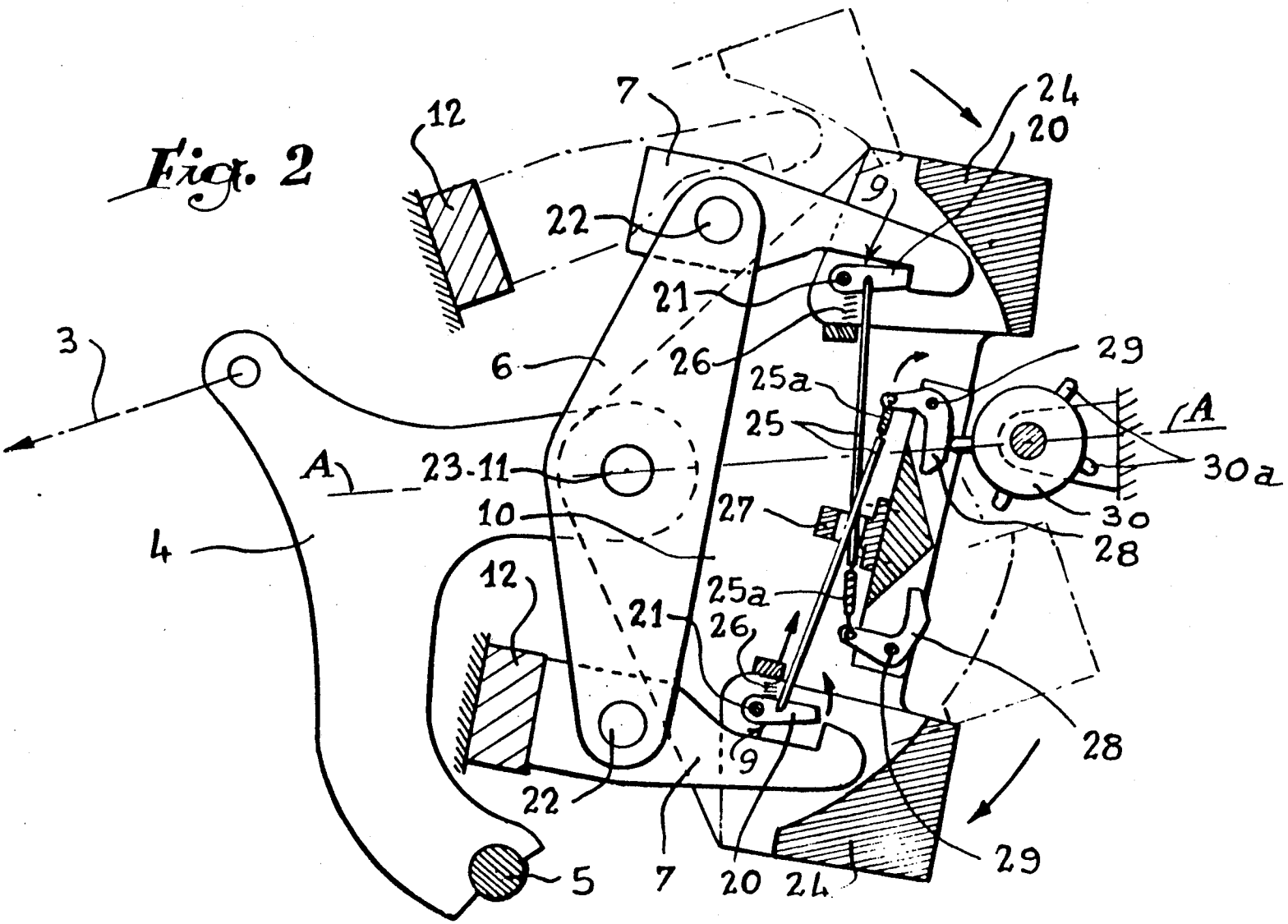
FIG. 2 is a similar section illustrating the arrangement of a dobby according to the invention.

Referring again to the drawings, reference 4 in FIG. 2 designates the oscillating lever which is connected by cable 3 to one of the heddle frames of the weaving machine and which is articulated at 5 on the frame of the dobby. As in FIG. 1, each lever 4 carries a double swinging lever 6, at the ends of which are mounted two coupling members 7 formed by pivoting drawing hooks which cooperate with the traction members 9 for controlling the double swinging lever 6 in question.

In FIG. 2, these traction members are constituted by locks 20 mounted idly on pins 21 disposed between the nose of the hooks 7 and the pivot 22 of each hook on the end of the double swinging lever 6, in the manner described in Applicants' U.S. Pat. No. 4,832,087. Pins 21, on which all the locks 20 of the different double swinging levers 6 of the dobby swivel, are supported by the oscillating plates 10, it being observed that, in FIG. 2, the double swinging lever 6 is shown in upper position for which its pivot 23 on the oscillating lever 4 merges with the shaft 11 which moves the plates 10 with the oscillating movement.

It should be observed here that the pins 21 which form pivots for the two assemblies of locks 20 of the dobby are advantageously carried by guide elements or reeds made in accordance with Applicants' French Patent No. 2 599 056 of May 20, 1986.

Furthermore, it will be noted that plates 10 also support guides 24 adapted to maintain the path of the drawing hooks 7 when the heel thereof is no longer in abutment against the fixed crosspieces 12 which are simple elements of square or rectangular section.

With each lock 20 is coupled a transmission element or tie-rod 25 adapted to act against a spring 26 which tends to maintain the lock engaged against the nose of the corresponding hook 7. The two opposite tie-rods 25 intersect inside a central guide 27 to articulate on reading elements formed by fingers 28, of bent profile in the example shown, mounted idly on two shafts 29 which are common to all the double swinging levers of the dobby and whose ends are carried, in the manner described in French Patent No. 2 599 056 mentioned above, by the two oscillating plates 10, in the same way as the central guide 27 mentioned above.

The selection system of the dobby further comprises a programmed actuation system constituted by a wheel with pegs 30 appropriately driven in rotation and whose arrangement corresponds to the weave of the fabric to be obtained.

Operation of the dobby described follows from the foregoing explanations and will be readily understood.

At the end of each of the oscillating strokes of plates 10 about the elongated axis of shaft 11, one of the two bent fingers 28 of each double swinging lever 6 has its actuation shank moved toward a plane of symmetry A—A taken through the axis of shaft 11 so as to be disposed adjacent the pegged wheel 30. If at that moment the wheel does not present a peg 30*a*, the finger 28 is not actuated, so that the corresponding lock 20 remains engaged against the conjugate drawing hook 7 which continues its oscillating displacement. If, on the contrary, the wheel 30 offers a peg 30*a* at the shank of finger 28, the finger pivots on pin 29, exerting an axial traction on the tie-rod 25 (case of the upper finger 28 in FIG. 2); the lock 20 is retracted by pivoting against its return spring 26, consequently releasing the lower hook 7 which will in that case no longer be driven with plates 10.

It may be observed that, as indicated above, the effort of selection is supported virtually entirely by the driving plates 10 since the cyclic rotation of the pegged wheel 30 intervenes only when the fingers 28 are not in abutment on its periphery. The pegs 30*a* in fact act like simple stops.

Of course, and despite the reliability of the system, it is advantageous to provide each tie-rod 25 with a safety spring 25*a* adapted to give the tie-rod a certain elastic deformability.

Figure 3:
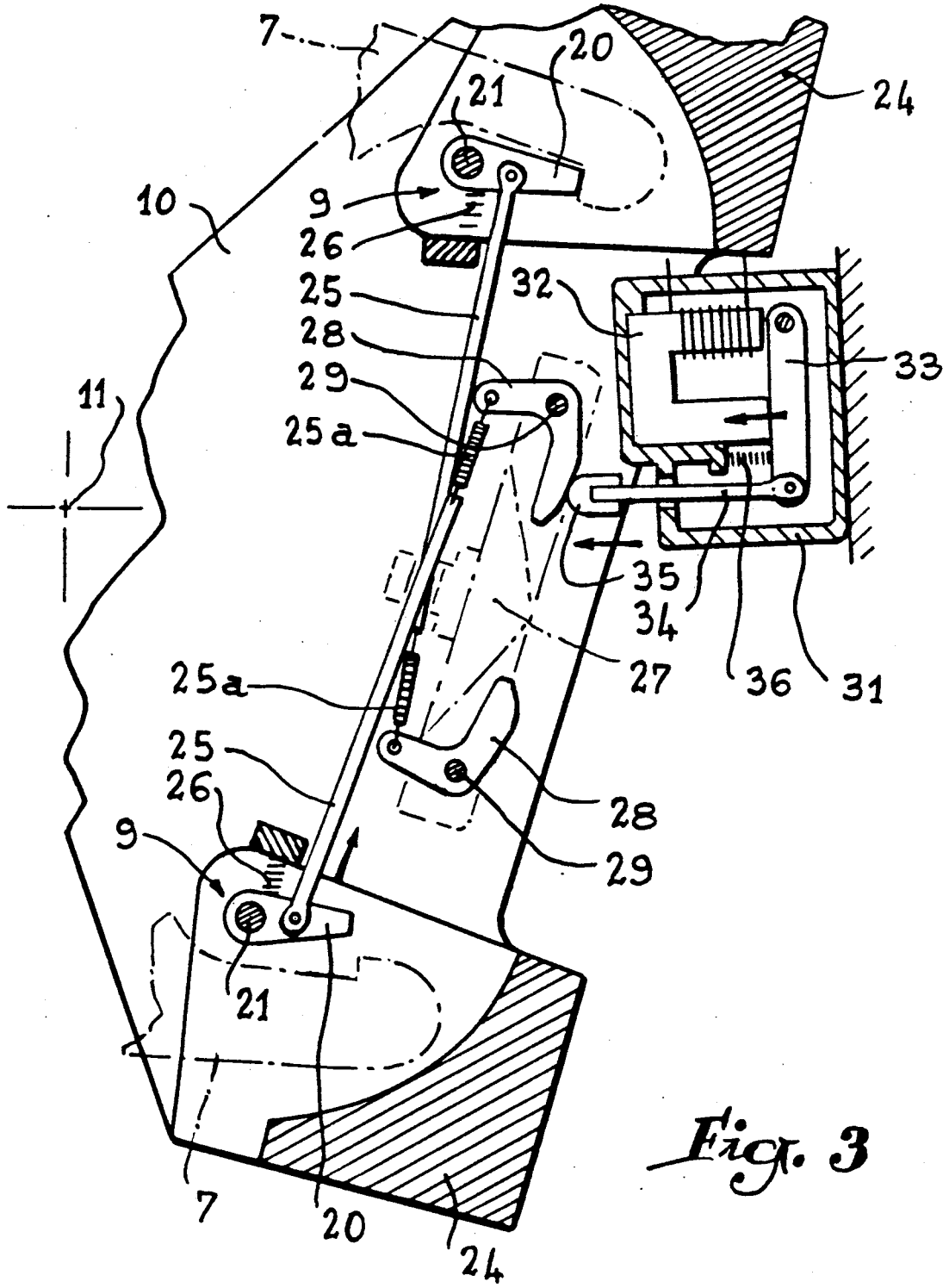
FIG. 3 shows another embodiment in which the selection system is constituted, no longer by a wheel with pegs, as in FIG. 2, but by an electromagnet assembly.

In the embodiment of the invention illustrated in FIG. 3, the selection system comprises a single fixed casing 31 which contains a number of electro-magnets 32 equal to that of the double swinging levers 6 of the dobby. Each electro-magnet 32 controls an articulated blade 33 which is coupled to a pusher 34 whose free end is advantageously capped with an endpiece 35. The electro-magnets 32 are selectively controlled as a function of the weaving program, in the manner known per se in the art of electronic dobbies.

Under these conditions, it will be readily appreciated that, when an electro-magnet 32 is energized, the attraction of its blade 33 against a return spring such as 36 provokes axial displacement of the pusher 34 whose endpiece 35 comes into position on the end-of-stroke path of one or the other of the two pivoting fingers 28 of the corresponding double swinging lever 6, with the result that the finger and its lock 20 are controlled via the tie-rod 25 shown. On the other hand, when the electro-magnet 32 is not energized, the blade 33 and the pusher 34 remain withdrawn, so that the endpiece 35 does not come into position on the path of the actuation shanks of fingers 28.

It should be observed that the effort that the electro-magnets 32 must exert to ensure control of the dobby is minimum and in fact is limited to the resistant effort exerted by each return spring 36, since the attraction of the blade 22 intervenes while the pusher 34 is not subject to any resistant effort; such effort is solely exerted when the blade 33 is applied against the pole of the electro-magnet 32, i.e. at the moment of adhesion which corresponds to the highest motive energy of the electro-magnet.

It will further be noted that such a selection system, comprising an assembly of electro-magnets which is fixed mounted and which, along, ensures control of the traction members of the top and the bottom of the dobby, lends itself particularly well to the production of dobbies of the synchronized type, capable of operating in reverse for unweaving operations.

Figure 4:
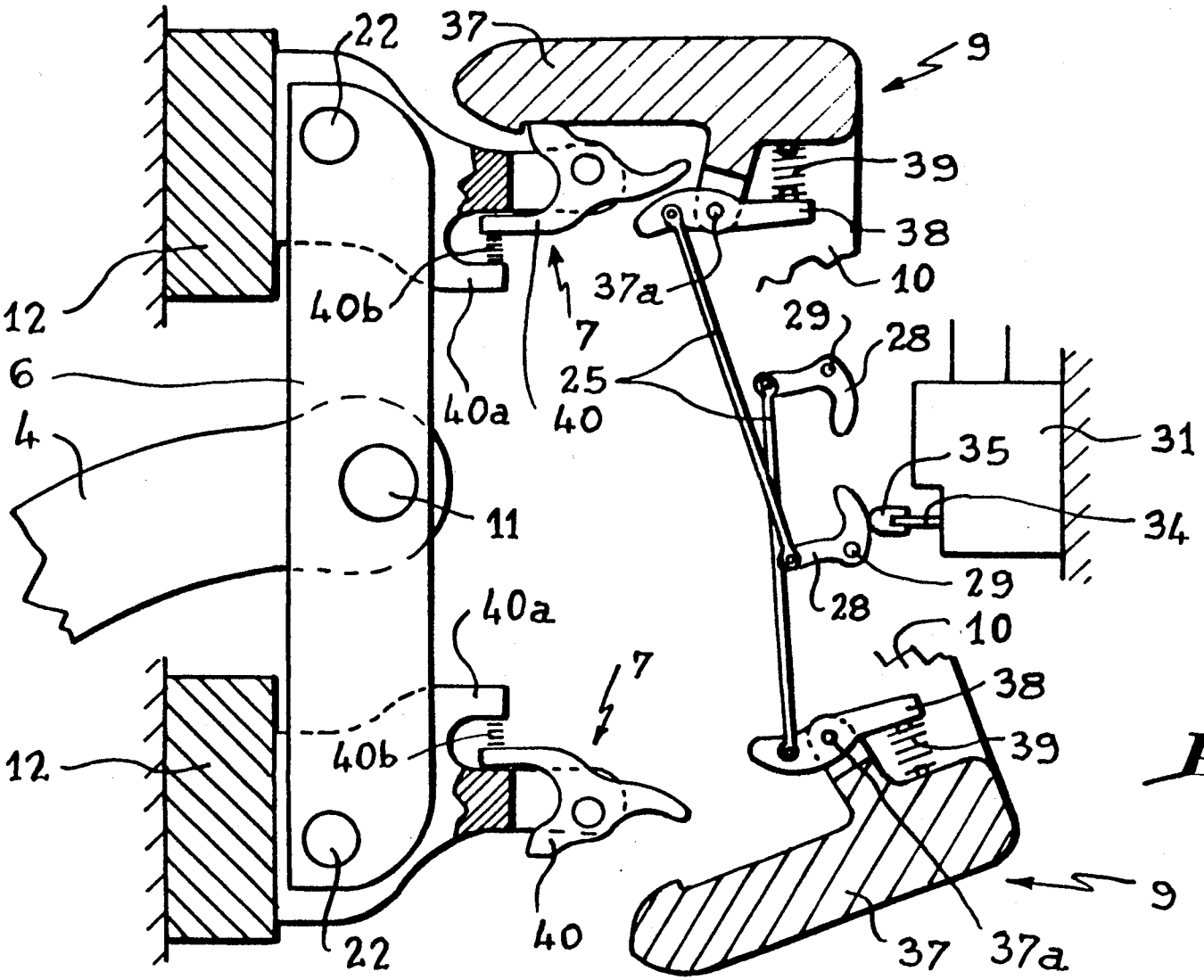
FIG. 4 illustrates another embodiment of the invention.

In the embodiment illustrated in FIG. 4, the traction members 9 are constituted by hooks 37 rigidly fixed on the pivoting plates 10 and equipped with small actuation levers 38 which are articulated at 37*a* on the hooks 37, being coupled to the tie-rods 25 and receiving the action of return springs 39. Each lever 38 is adapted to ensure control of a coupling member 7 constituted by a pivoting lock 40 carried by the free end of an arm 40*a* articulated on one of the two pivots 22 of each double swinging lever 6. A spring 40*b* effects elastic return of each lock 40 to the position of engagement with the nose of the traction hook 37 which corresponds thereto.

Otherwise, operation is identical to that described with reference to FIG. 3.

It will be readily appreciated that the invention may be carried out in the case of the mobile traction members 9 being constituted, no longer by locks working in compression, but by slide blocks of the type such as those shown in FIG. 1, working in shear, or by conventional pivoting hooks working in flexion.

What is claimed is:

1. In a double lift dobby for weaving machines of the type including double swinging levers having two ends and wherein coupling members are each pivotally mounted at a first end to each end of the levers and wherein a programmed actuation assembly is used to control the movement of the levers, the improvement comprising, movable traction members carried by plates which are mounted to oscillate relative to each lever, said traction members being movable to a first position in which they engage a second end of each of said coupling members from a second position where they are spaced from said ends of said members, transmission means carried by said plates and connected to said traction members, means fixedly mounting said actuation assembly relative to said plates, and said actuation assembly including movable stop means for selectively actuating said transmission means to thereby control said traction members to move to their said first or second position.

2. The double lift dobby of claim 1 wherein said transmission means includes opposite intersecting tie-rods each having one end connected to said traction members and another end connected to a separate of two movable finger elements carried by said plates, said plates being oscillated about a pivot axis, and said finger elements being mounted on either side of a plane of symmetry extending through said pivot axis and intermediate said traction member.

3. The double lift dobby of claim 2 wherein said movable stop means includes a rotating wheel, a plurality of spaced peg means extending outwardly of said rotating wheel so as to be selectively engageable with one of said finger elements positioned adjacent thereto.

4. The double lift dobby of claim 2 wherein said movable stop means includes an electromagnetic means having a movable blade and a reciprocating element connected to said movable blade, said reciprocating element including an outer pusher surface for selectively engaging said finger elements.

5. The double lift dobby of claim 1 in which said plates are pivotally mounted to oscillate about a first axis and said double swinging levers are pivotable about an axis which is aligned with said first axis.

6. The double lift dobby of claim 1 including resilient means for normally urging said traction members to said first position.

7. The double lift dobby of claim 1 wherein said movable stop means includes a rotating wheel, a plurality of spaced peg means extending outwardly of said rotating wheel so as to be selectively engageable with said transmission means.

8. The double lift dobby of claim 1 wherein said movable stop means includes an electromagnetic means having a movable blade and a reciprocating element connected to said movable blade, said reciprocating element including an outer pusher surface for selectively engaging said transmission means.

* * * * *